US007690656B2

(12) United States Patent
Saunders

(10) Patent No.: US 7,690,656 B2
(45) Date of Patent: Apr. 6, 2010

(54) SELF-RESETTING PADDLE TARGET

(76) Inventor: Charles A. Saunders, 8380 36th Ave., Columbus, NE (US) 68061

( * ) Notice: Subject to any disclaimer, the term of this patent is extended or adjusted under 35 U.S.C. 154(b) by 0 days.

(21) Appl. No.: 12/350,954

(22) Filed: Jan. 8, 2009

(65) Prior Publication Data

US 2009/0174147 A1 Jul. 9, 2009

Related U.S. Application Data

(60) Provisional application No. 61/020,143, filed on Jan. 9, 2008.

(51) Int. Cl.
*F41J 7/00* (2006.01)

(52) U.S. Cl. ..... 273/392; 273/406

(58) Field of Classification Search ..... 273/390–392, 273/403–410

See application file for complete search history.

(56) References Cited

U.S. PATENT DOCUMENTS 2,443,131 A * 6/1948 Fessler ..... 473/453
3,979,118 A 9/1976 Saunders et al.
4,093,227 A 6/1978 Saunders et al.
4,210,326 A 7/1980 Booth et al.
4,614,345 A 9/1986 Doughty
4,657,261 A 4/1987 Saunders
4,810,561 A 3/1989 King
5,810,363 A 9/1998 Saunders et al.
6,398,215 B1 6/2002 Carroll
6,435,512 B1 * 8/2002 Beckwith, Sr. ..... 273/407
6,994,349 B2 2/2006 Lambert
7,134,977 B2 * 11/2006 Campbell et al. ..... 473/454

OTHER PUBLICATIONS

International Search Report for PCT/US09/30508.

* cited by examiner

*Primary Examiner*—Mark S Graham
(74) *Attorney, Agent, or Firm*—Levenfeld Pearlstein, LLC

(57) ABSTRACT

A self-resetting paddle target is comprised of at least one paddle mounted to a carrier body. The carrier body is rotatably mounted to a support rod such that the carrier body may freely rotate about the support rod. The carrier body is formed as a cam follower configured to engage the upper surface of a carrier support member fixedly fastened to the support rod and that acts as a cam. The interaction of the carrier body and the carrier support member controls the rotation of the carrier body about the support rod and allows the paddle to reset itself after being impacted by a projectile. A plurality of paddles may be disposed along the support rod.

15 Claims, 15 Drawing Sheets

SELF-RESETTING PADDLE TARGET

CROSS-REFERENCE TO RELATED APPLICATIONS

This application claims the benefit of U.S. Provisional Application No. 61/020,143, filed Jan. 9, 2008, which is incorporated by reference in its entirety.

BACKGROUND OF THE INVENTION

The present invention relates generally to targets, and more particularly to a self-resetting paddle target that may be used with a wide variety of projectiles.

Target devices are well known in the art. Such devices often are used to practice marksmanship for recreational purposes and are also widely used in competitive marksmanship settings.

Numerous types and styles of targets have been developed, intended to be used with various types of projectiles, such as arrows, shot and bullets. The targets can be in the form of a relatively simple plastic sheet marked with a "bulls-eye" and secured to a backstop material, or can be relatively complex mechanical devices with cantilevered arms and sophisticated counterbalancing systems.

For example, in the field of archery alone, prior art targets run the gamut from simple 10-circle paper targets attached to a bag, tree or bale of hay, to block targets utilizing a friction foam design, to three-dimensional foam core targets formed in the shapes of animals.

Other types of targets are known, again particularly in the archery field. U.S. Pat. No. 5,810,363 for a "Target Assembly," for example, discloses a target having a tensioned web material that absorbs the impact force of the projectile and automatically resets itself for the next projectile. U.S. Pat. No. 4,657,261 for a "Spring Mounted Silhouette Archery Target Apparatus" discloses a structure configured to receivingly stop and hold an arrow while pivoting backwards to absorb some of the shock of the impact of the arrow. Finally, U.S. Pat. Nos. 4,093,227 and 3,979,118 teach a target device having a pair of targets mounted at a generally right angle to one another with a shock absorber means disposed between the targets.

Outside of the archery field, numerous additional types of targets are known. For example, in the field of guns and air rifles, the prior art has developed paddles, typically comprised of steel, specifically configured to withstand the high velocity associated with projectiles fired from such devices. Known prior art targets in this field often use a spring mechanism to help absorb the high impact forces generated by such projectiles.

Despite the numerous types of targets known in the prior art, the prior art has not developed a self-resetting paddle target having a simple mechanical dampening mechanism that permits the target to be used with many different types of projectiles, from baseballs, footballs, soccer balls and the like, to arrows, to high speed bullets fired from guns or air rifles. The present invention provides such a target.

Desirably, the self-resetting paddle target of the present invention can be adapted to be used with a wide range of projectiles of varying velocities. More desirably, the self-resetting paddle target of the present invention comprises a cam and cam follower mechanism for controlling and limiting the movement of the paddles and for allowing the paddles to reset themselves after being impacted by a projectile. Most desirably, the self-resetting paddle target of the present invention includes a protective apron that not only protects the target's mechanics from the projectiles, but also acts as a dampening device for the paddles.

BRIEF SUMMARY OF THE INVENTION

The present invention comprises a self-resetting paddle target. The target is comprised of at least one paddle mounted to a carrier body. The paddle may be flexible or rigid depending upon the speed of the projectile used with the target.

The carrier body is rotatably mounted to a support rod such that the carrier body may freely rotate about the support rod with the paddle extending therefrom. The bottom surface of the carrier body is formed as a cam follower configured to engage the upper surface of a carrier support member that is fixedly fastened to the support rod and that acts as a cam.

The interaction of the carrier body (the cam follower) and the carrier support member (the cam) controls the rotation of the carrier body about the support rod and allows the paddle to reset itself after being impacted by a projectile.

The paddle target further comprises a frame and a protective apron, the protective apron acting both to protect the target's mechanics from damage by projectiles and to provide a dampening effect to the paddle. A plurality of paddles may be disposed along the support rod.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
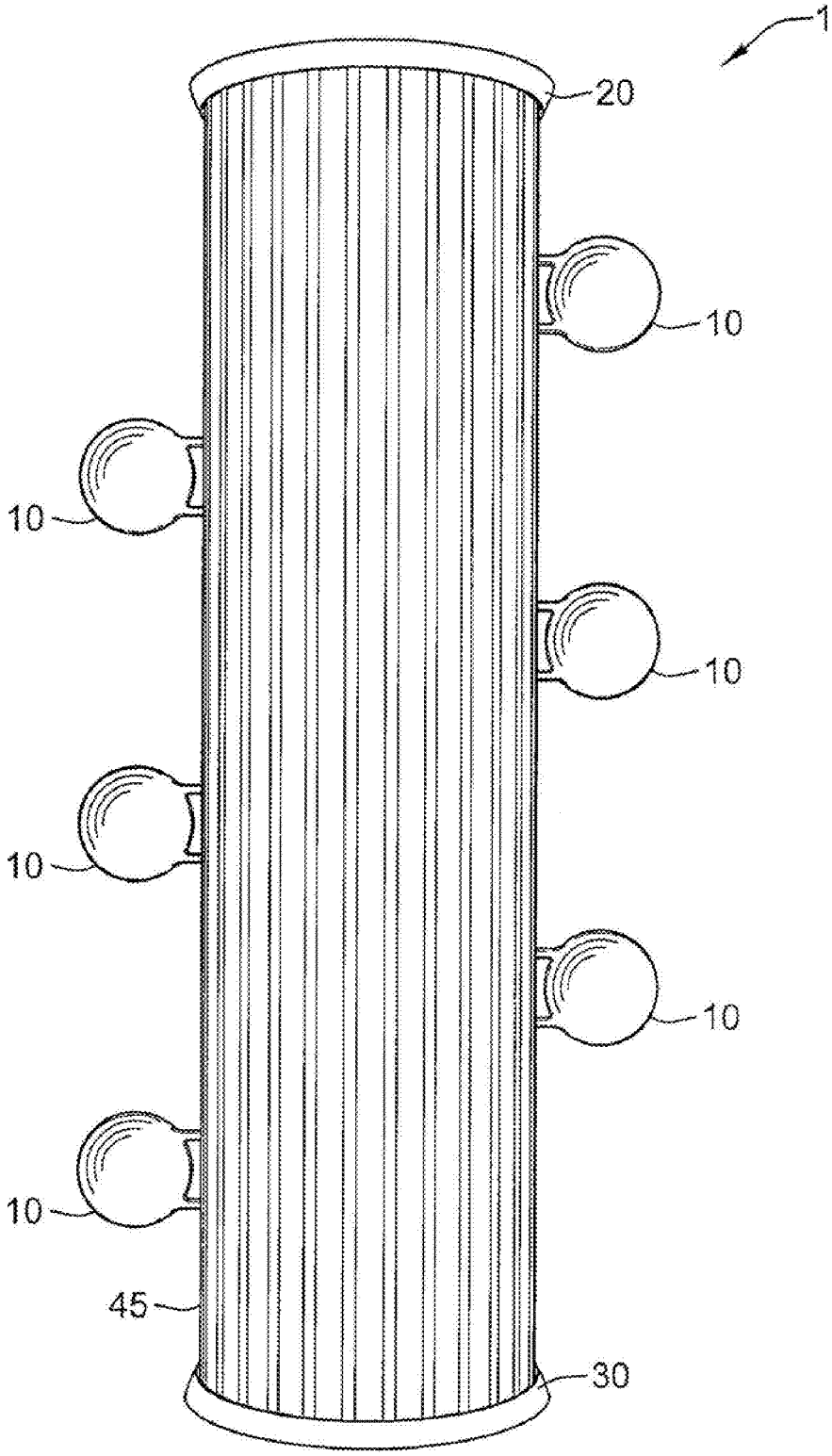
FIG. 1 is a front perspective view of the self-resetting paddle target embodying the principles of the present invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description of the Invention," relates to a requirement of the United States Patent Office, and does not imply, nor should be inferred to limit the subject matter disclosed herein.

As shown generally in FIGS. 1-14, and more particularly in FIG. 1, self-resetting paddle target 1 of the present invention is a generally vertical structure comprising at least one (and preferably a plurality) of paddles 10.

Figure 2:
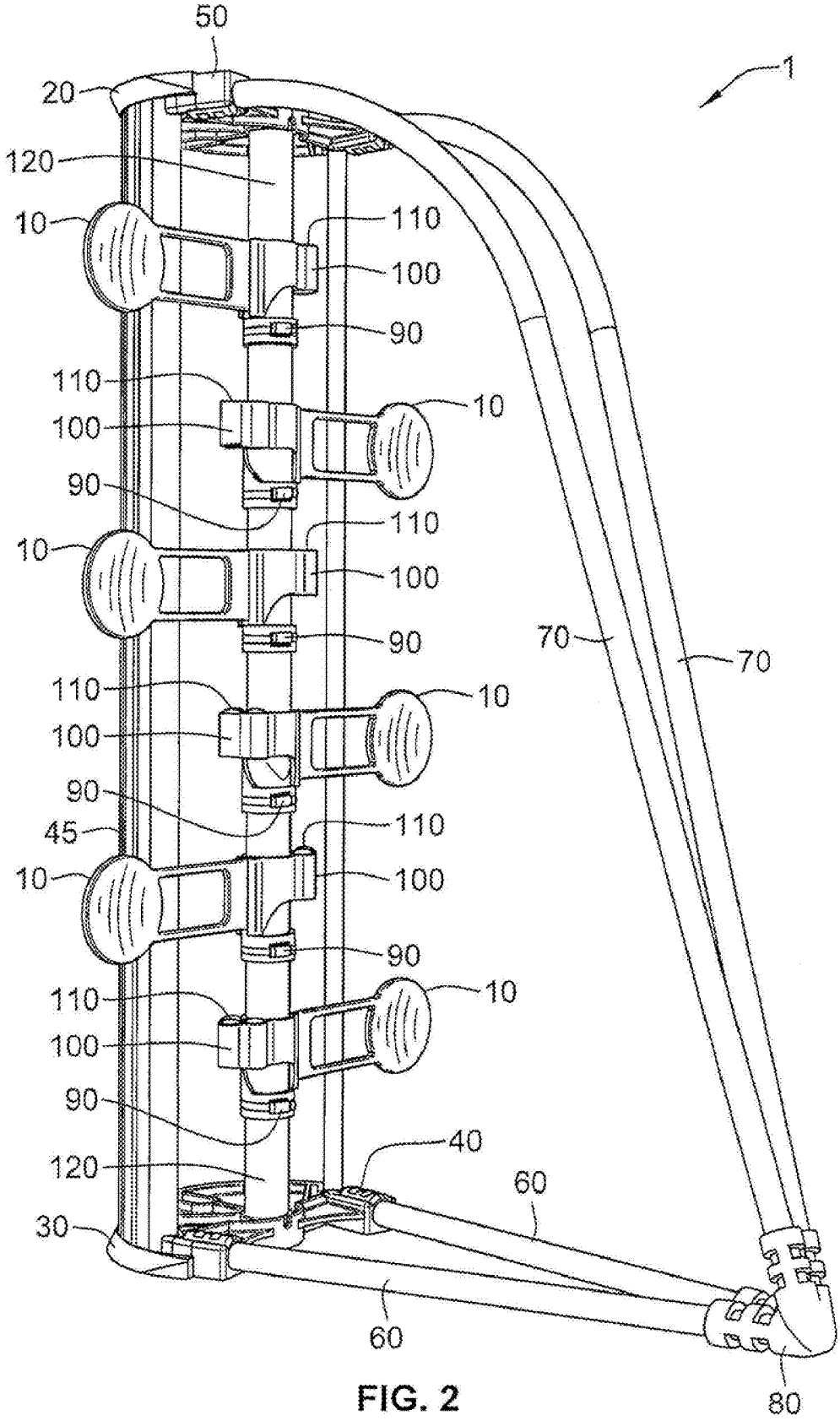
FIG. 2 is a rear perspective view of the self-resetting paddle target embodying the principles of the present invention.
Figure 4:
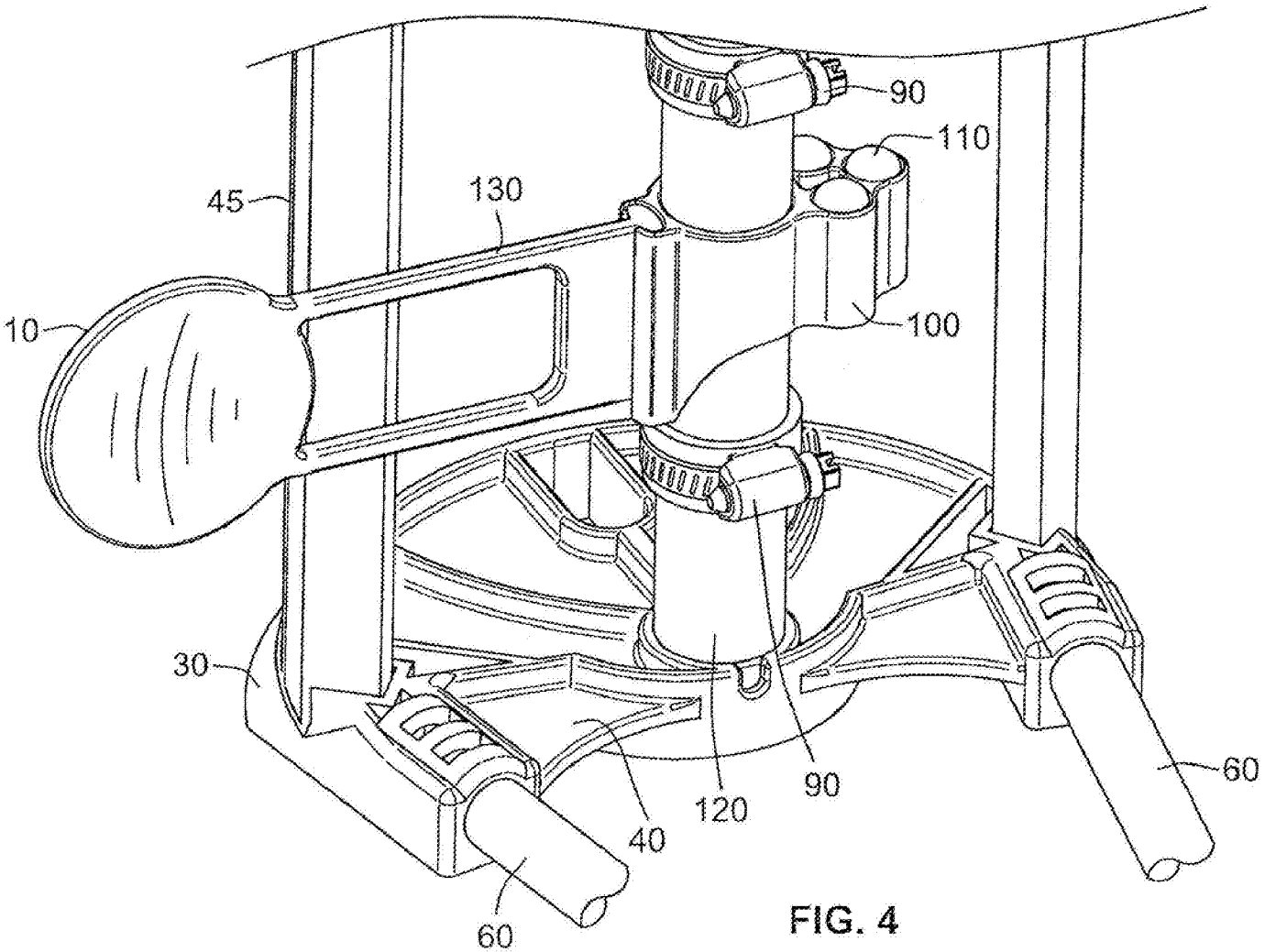
FIG. 4 is an enlarged fragmentary rear perspective view of the self-resetting paddle target embodying the principles of the present invention.

Paddles 10 are configured to extend outwardly, in a generally horizontal orientation, perpendicular to the vertical axis of target 1, and are further configured to rotate about a central vertical support rod 120, as further shown in FIGS. 2 and 4.

In this manner, when paddles 10 are struck by a projectile on one side of the central vertical axis of target 1, paddles 10 rotate about support rod 120 (following an arcuate path across the rear of target 1) and move to the other side of target 1 ready to again be struck by a projectile.

Figure 3:
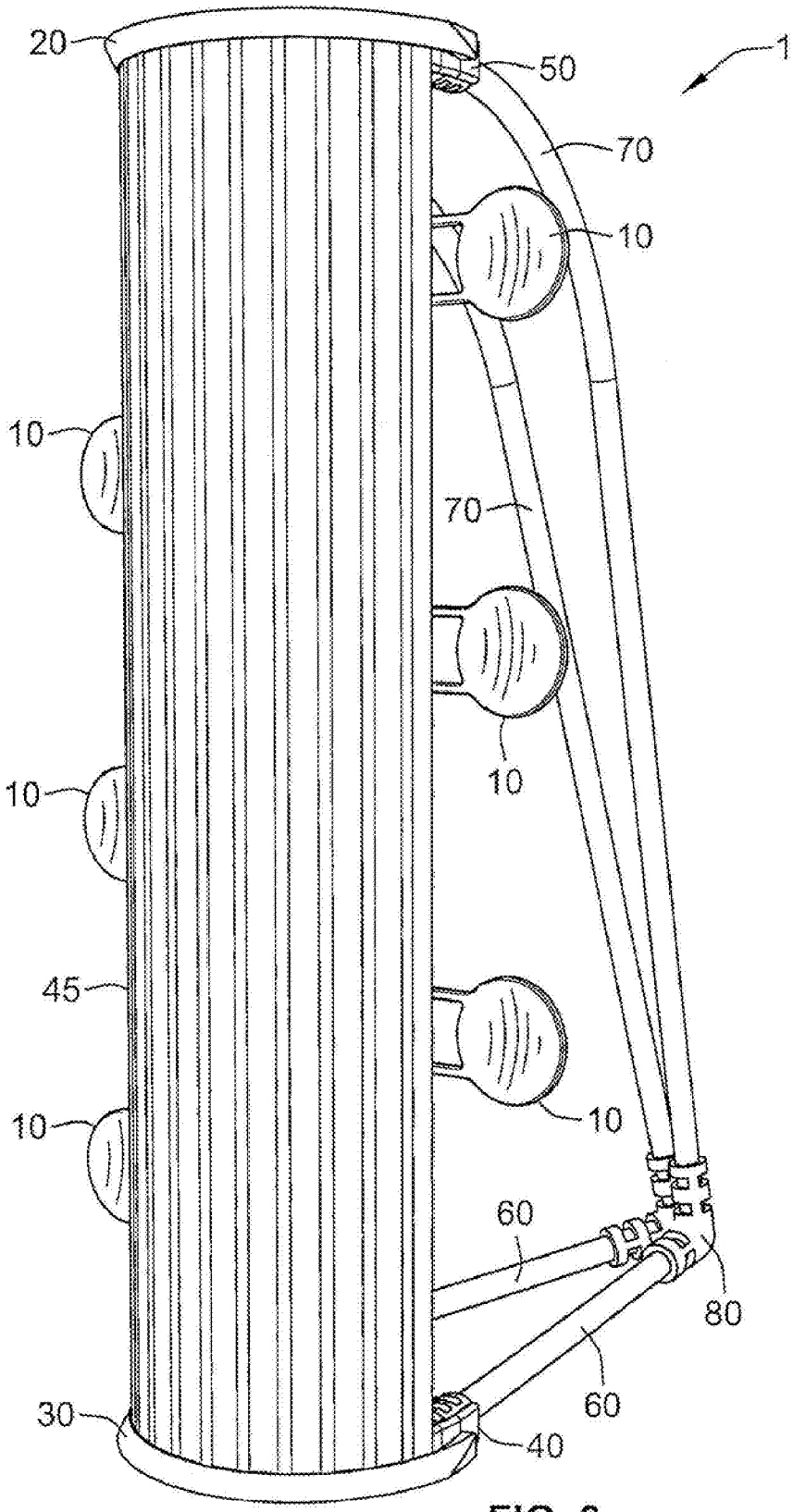
FIG. 3 is a side perspective view of the self-resetting paddle target embodying the principles of the present invention.

For example, in the configuration of target 1 as shown in FIGS. 1-3, if a projectile is fired at a paddle target 10 disposed on the right side of target 1, the impact of the projectile will cause such paddle target 10 to rotate rearwardly behind target 1 and about support rod 120 until paddle target 10 comes to rest on the left side of target 1, ready to be impacted by another projectile.

It will be appreciated that, in the context of self-resetting paddle target 1 of the present invention, a projectile may include numerous type of projectiles, including but not limited to: baseballs, footballs, soccer balls and the like (generally thrown or kicked), shot (propelled by a slingshot or similar device), arrows (shot from a bow) and bullets (fired from a gun or air rifle). Those skilled in the art will recognize the wide variety of projectiles that may be used with target 1.

Figure 5:
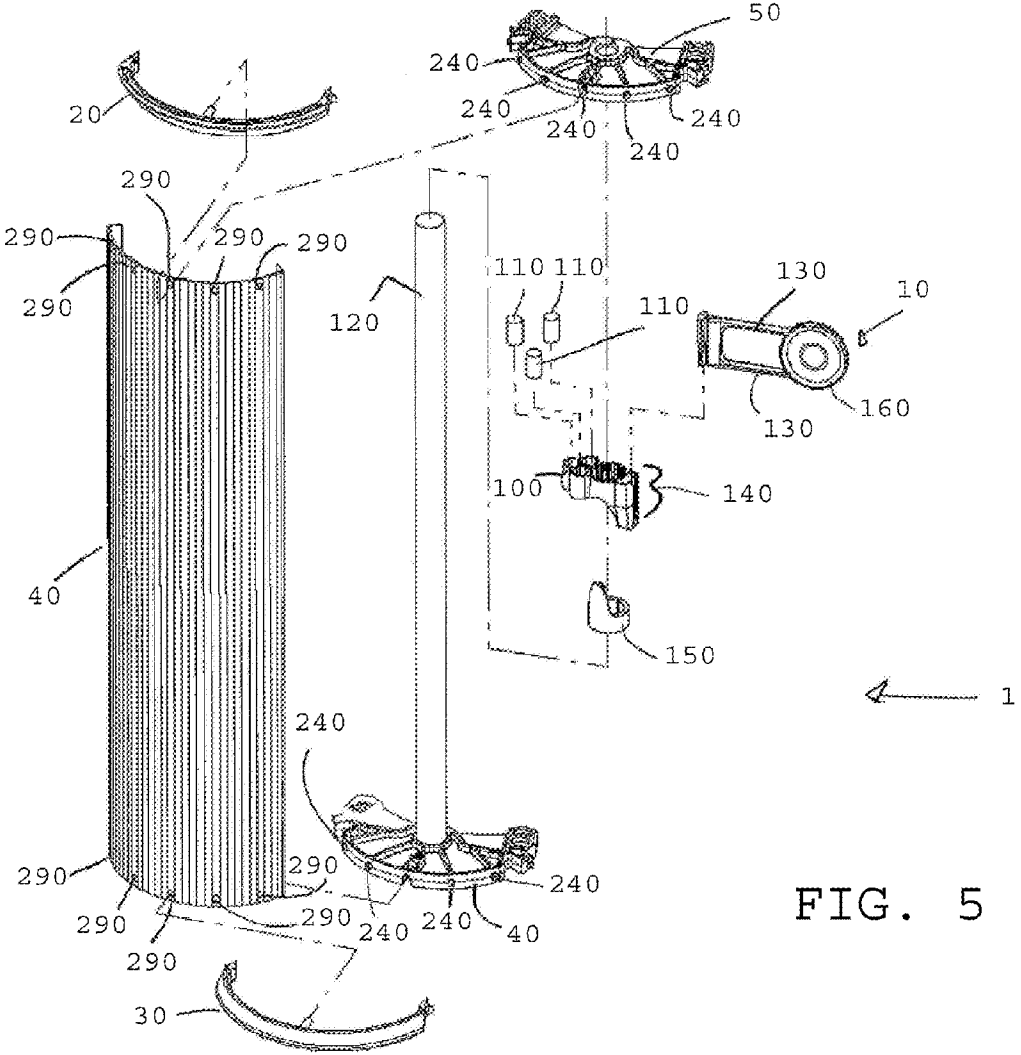
FIG. 5 is a partially exploded view of the self-resetting paddle target embodying the principles of the present invention.
Figure 9:
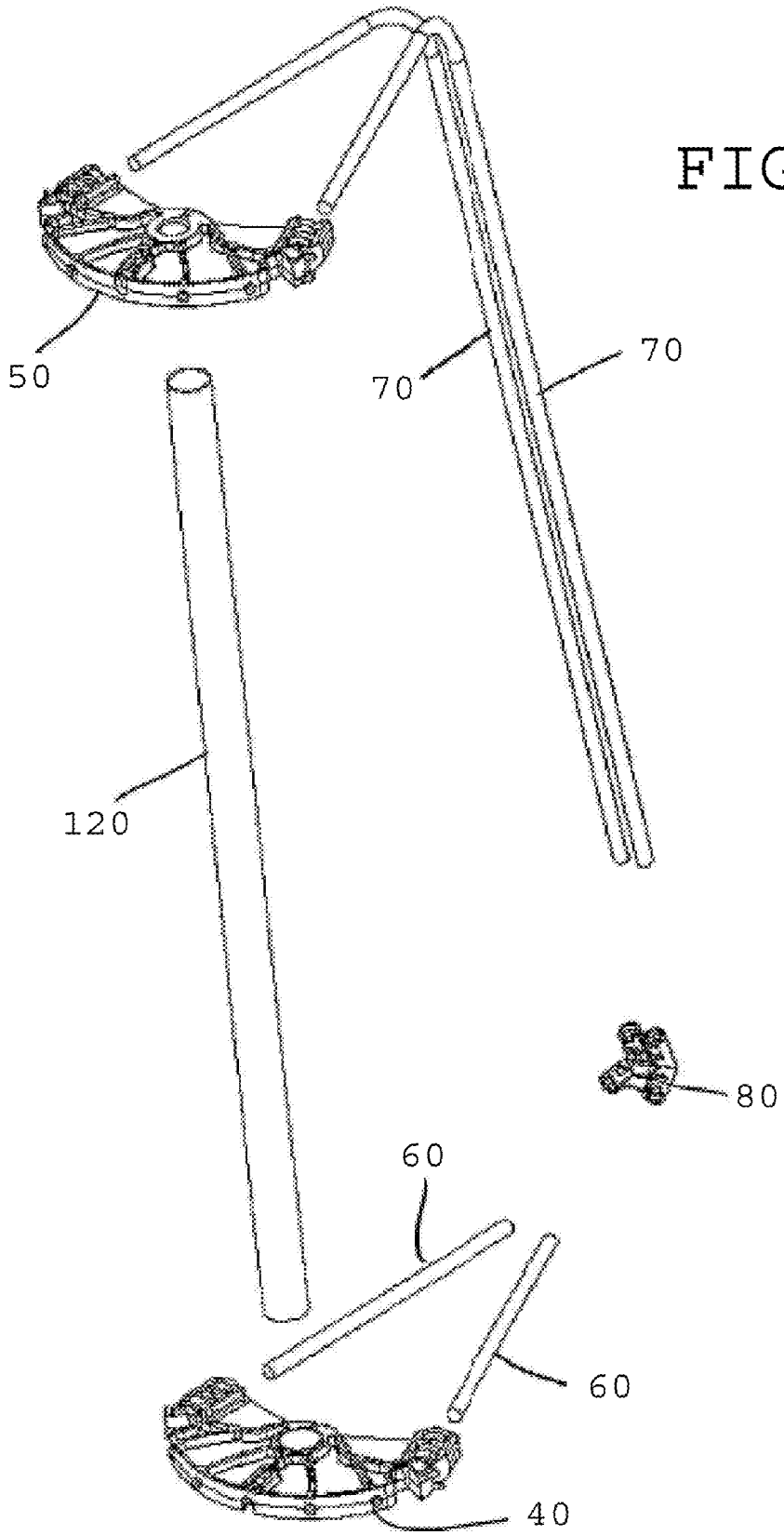
FIG. 9 is an exploded view of the frame components of the self-resetting paddle target embodying the principles of the present invention.

In the preferred embodiment, as shown in FIGS. 2-3 and 5, but particularly in FIG. 9, target 1 comprises a frame having a base member 40 and a cap member 50. Disposed between base member 40 and cap member 50 is a support rod 120, a generally vertical member about which paddles 10 are rotatably mounted.

Figure 10:
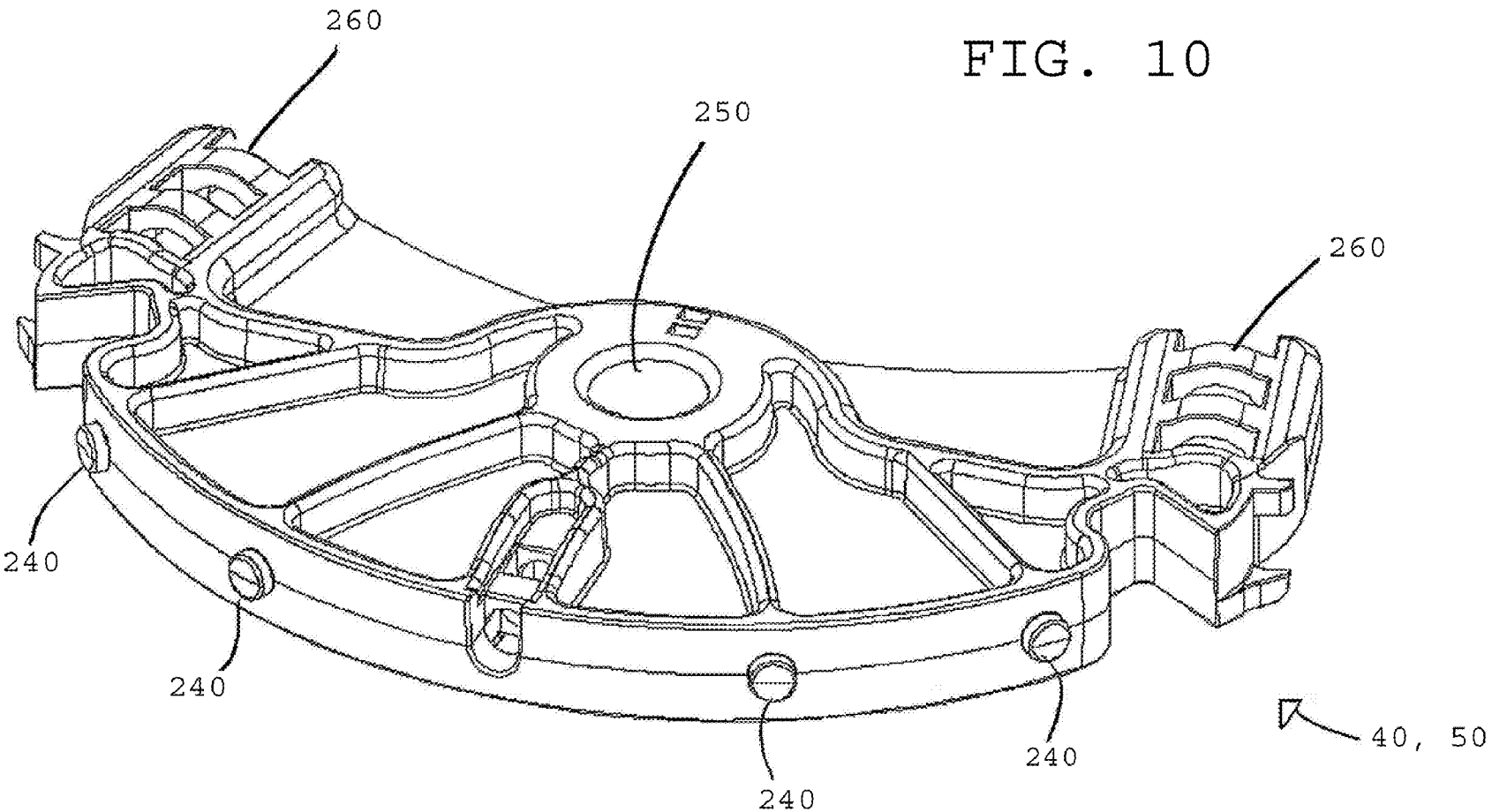
FIG. 10 is an enlarged perspective view of the base and cap members of the self-resetting paddle target embodying the principles of the present invention.

Support rod 120 fits within holes 250 formed in base member 40 and cap member 50 (as shown most clearly in FIG. 10). Support rod 120 may be friction fit, glued and/or secured with a mechanical fastener, such as a screw, within holes 250 of base member 40 and cap member 50.

Support rod 120 preferably is a tube-shaped member that supports the entire target 1. Those skilled in the art will recognize that support rod 120 can be made of various materials, but support rod 120 should be sturdy and, preferably, lightweight. A high-strength plastic is used in the preferred embodiment.

The length of support rod 120 determines how many paddles 10 can be mounted on target 1. The longer support rod 120, the more paddles 10 that can be mounted on target 1. Of course, as the length of support rod 120 increases, so will the length of the protective apron 45, as discussed below.

As shown in FIGS. 9-10, base member 40 and cap member 50 further comprise openings 260 for receiving frame rods 60 and 70, respectively, that extend rearwardly from target 1 and provide support to maintain target 1 in a generally upright, vertical orientation.

Figure 11:
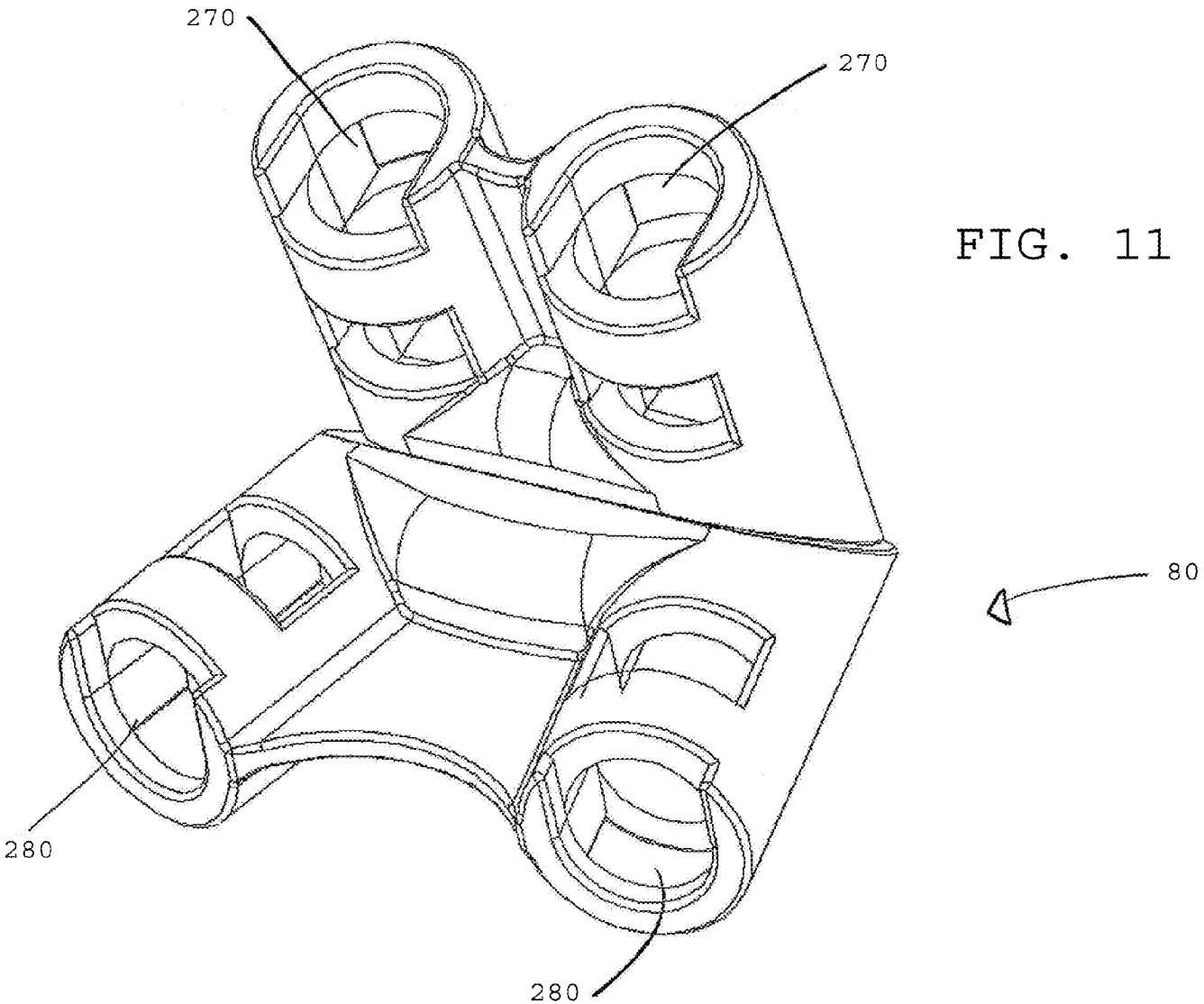
FIG. 11 is an enlarged perspective view of the frame joint bracket of the self-resetting paddle target embodying the principles of the present invention.

Frame rods 60, 70 are connected to one another through a frame joint bracket 80 (as shown in FIGS. 2-3 and 9, and particularly in FIG. 11). In this manner frame rods 60, 70 provide a sturdy, durable structure able to support target 1 when paddles 10 are struck by projectiles.

Preferably, frame rods 60, 70 are tubular and are formed of a sturdy, high-strength material, such as aluminum. However, those skilled in the art that other suitable materials can be used.

It should be noted that base member 40 and cap member 50, in the preferred embodiment, are formed as identical members for ease of manufacture and assembly of target 1. Thus, FIG. 10 depicts both base member 40 and cap member 50 in a single drawing. However, those skilled in the art will recognize that base member 40 and cap member 50 need not be identical.

As further shown in FIG. 10, the front surface of each of base member 40 and cap member 50 is formed with a large radius circumference. Extending forwardly from the front surface of each of base member 40 and cap member 50 are a plurality of male protrusions 240 configured to matingly engage holes 290 formed in the protective apron 45, as further discussed below.

As discussed above, and as shown in FIGS. 1-3, disposed along the length of support rod 120 is a least one paddle 10 mounted to a carrier body 140. In the preferred embodiment, a plurality of paddles 10 each are mounted to a carrier body and disposed along the length of support rod 120.

Figure 6:
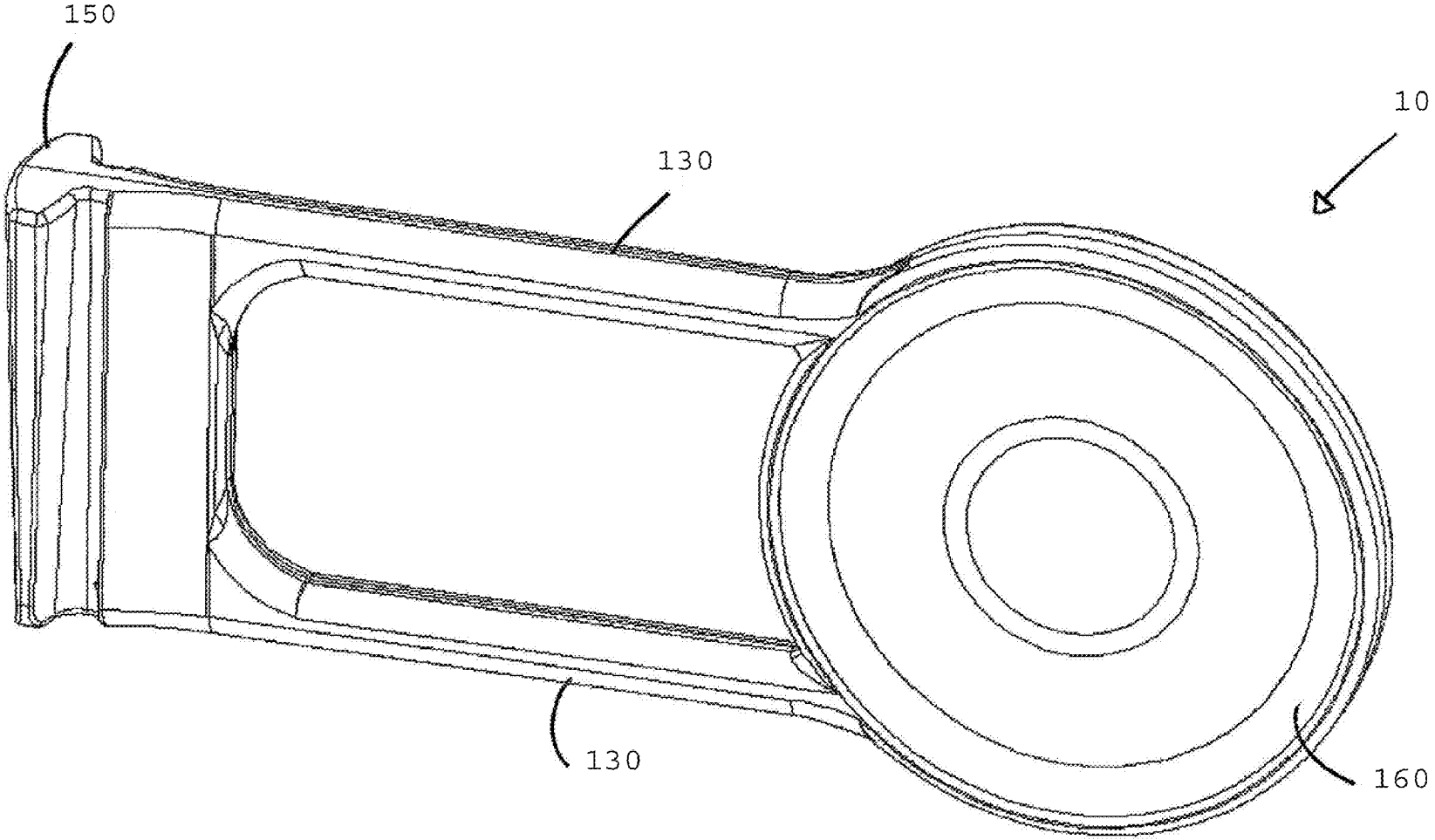
FIG. 6 is an enlarged perspective view of the paddle embodying the principles of the present invention.

As illustrated most clearly in FIG. 6, paddle 10 preferably comprises a circular disc 160 (although it can be any desired shape), a connecting strut (or struts) 130 and a wedge shaped male protrusion 150. In the preferred embodiment two connecting struts 130 (upper and lower) connect circular disc 160 to wedge shaped male protrusion 150, although those skilled in the art will recognize that a single strut (or a unibody design) may be used.

The material of paddle 10 can be flexible or rigid depending on the speed of the projectile to be used with target 1, the type of dampening reaction is desired from the initial contact with the projectile and how paddle 10 interacts with the dampening apron 45.

Figure 14:
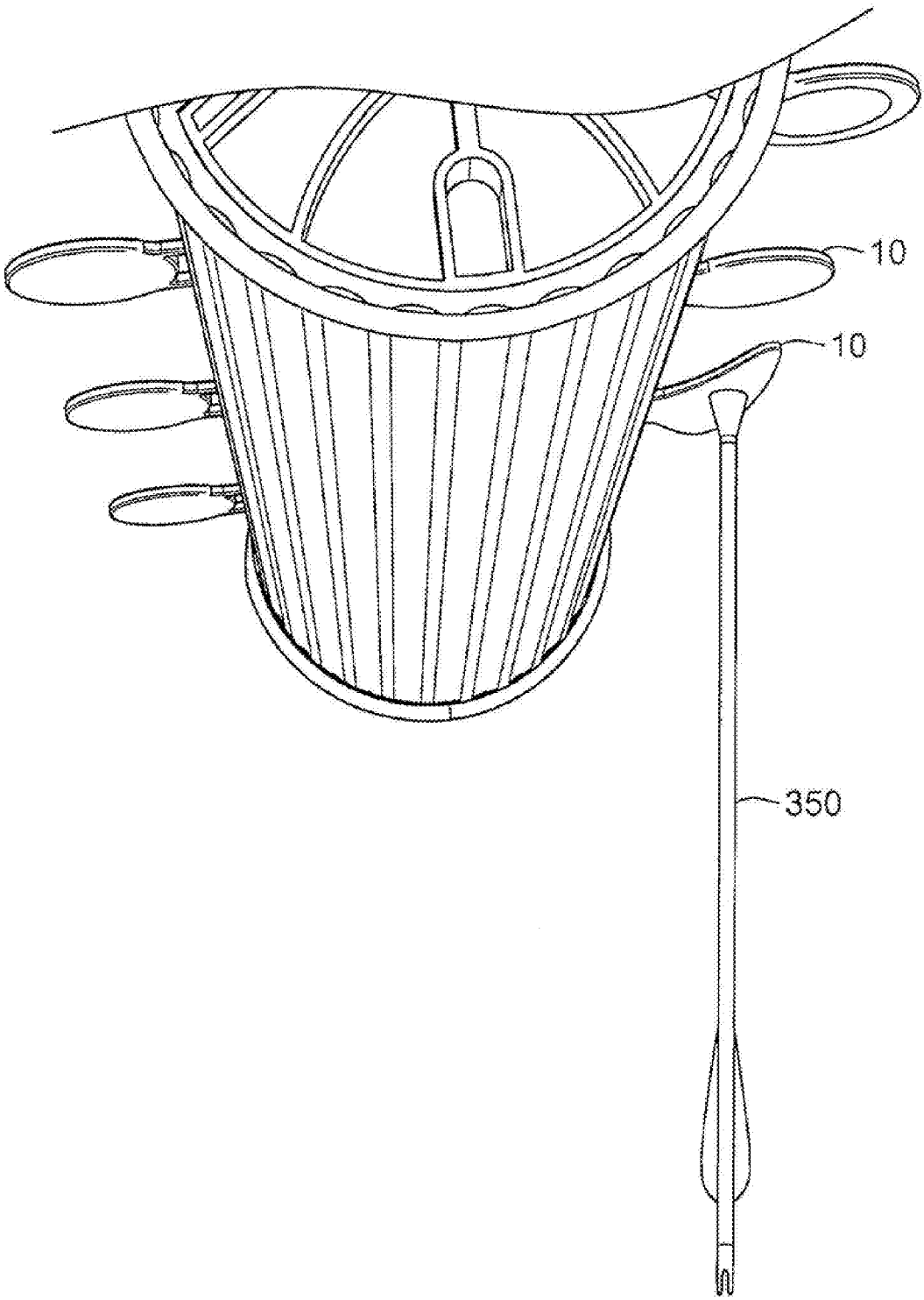

For example, as shown in FIG. 14, paddle 10 may be formed of a flexible plastic material when used with arrow projectiles. However, for high speed projectiles, such as bullets, paddle 10 may be formed of a rigid material, such as steel, which is strong enough to be impacted by such projectiles without damaging the paddle 10.

Advantageously, target 1 of the present invention allows for multiple paddles 10 of different rigidity to be mounted on support rod 120. In his manner, users of target 1 can simultaneously use multiple projectile devices (such as an arrow and an air rifle) while practicing or, for example, while competing with another user.

Figure 7:
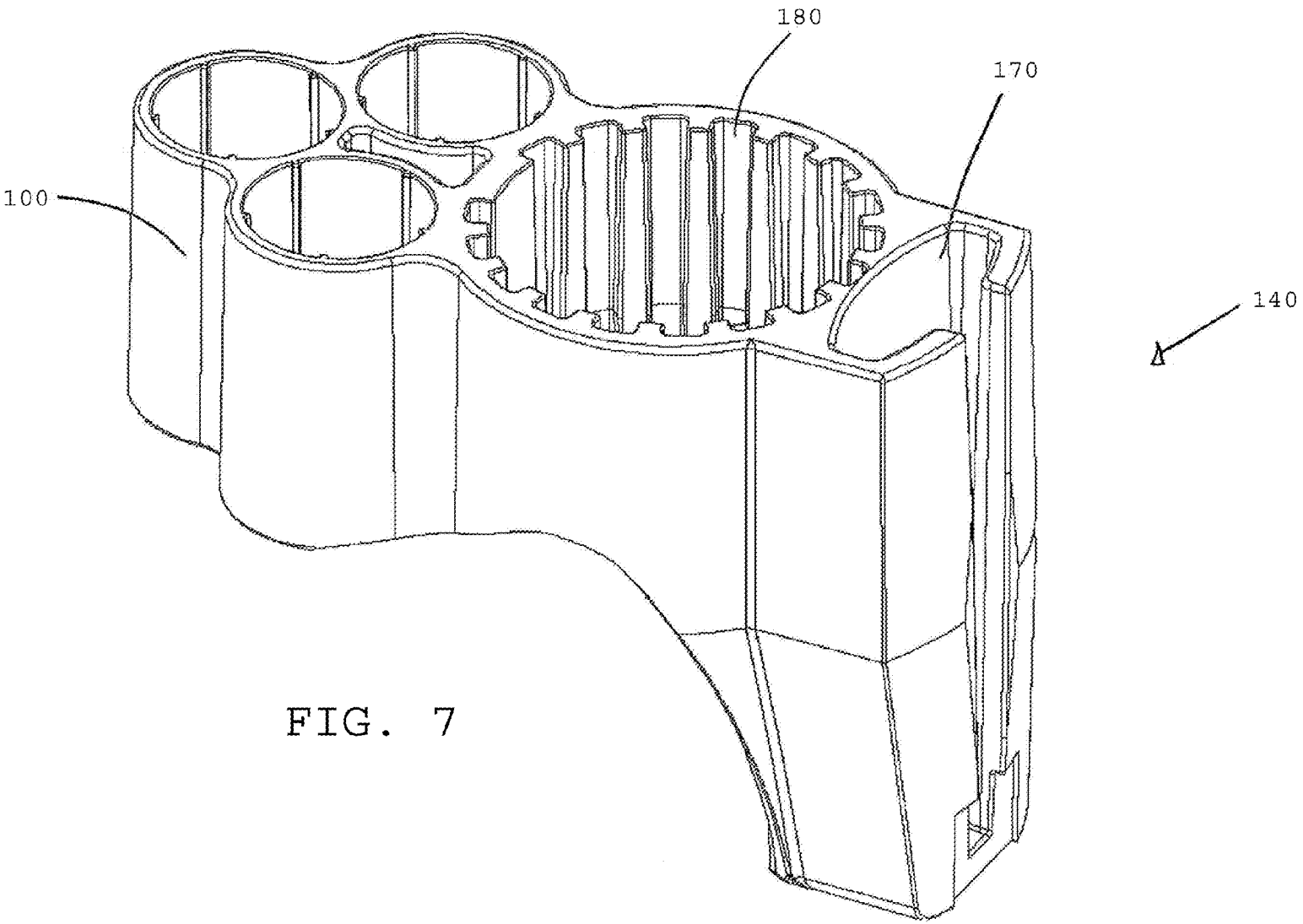
FIG. 7 is an enlarged perspective view of the carrier body embodying the principles of the present invention.

As shown in FIG. 7, carrier body 140 is comprised of a female wedge slot 170 configured to receive the wedge shaped male protrusion 150 of paddle 10. In this manner, paddle 10 may be readily slidably engaged with and disengaged from carrier body 140 to allow for easy installation and replacement of paddle 10 without the need for tools.

This design, for example, enables a worn paddle 10 to be replaced, more or less flexible paddles 10 to be installed for tuning purposes and/or different style or type of paddles 10 to be used the change the game or adapt to different types of projectiles—such as thrown baseballs, footballs or kicked soccer balls, etc.—as discussed above.

As further shown in FIG. 7, carrier body 140 further comprises a central opening 180 which is configured to rotatably engage support rod 120 and to allow carrier body 140 to rotate freely about support rod 120. Preferably, central opening 180 is formed with a plurality of grooves or channels as shown in FIG. 7.

The groves are configured to help keep the support rod/carrier body interface clean so that carrier body 140 may freely rotate around support rod 120. That is, the grooves allow dirt and other potential materials that would interfere with the movement of carrier body 140 around support rod 120 to pass through central opening 180.

Carrier body 140 further comprises a counter balance receiver 100 configured to accept counterweights 110 (as shown, for example, in FIG. 4). In the preferred embodiment of target 1, counterweights 110 advantageously counter-balance the weight of the paddle 10. While counterweights 110 are not required for operation of target 1, they help prevent carrier body 140 from binding as it travels around support rod 120.

Figure 7A:
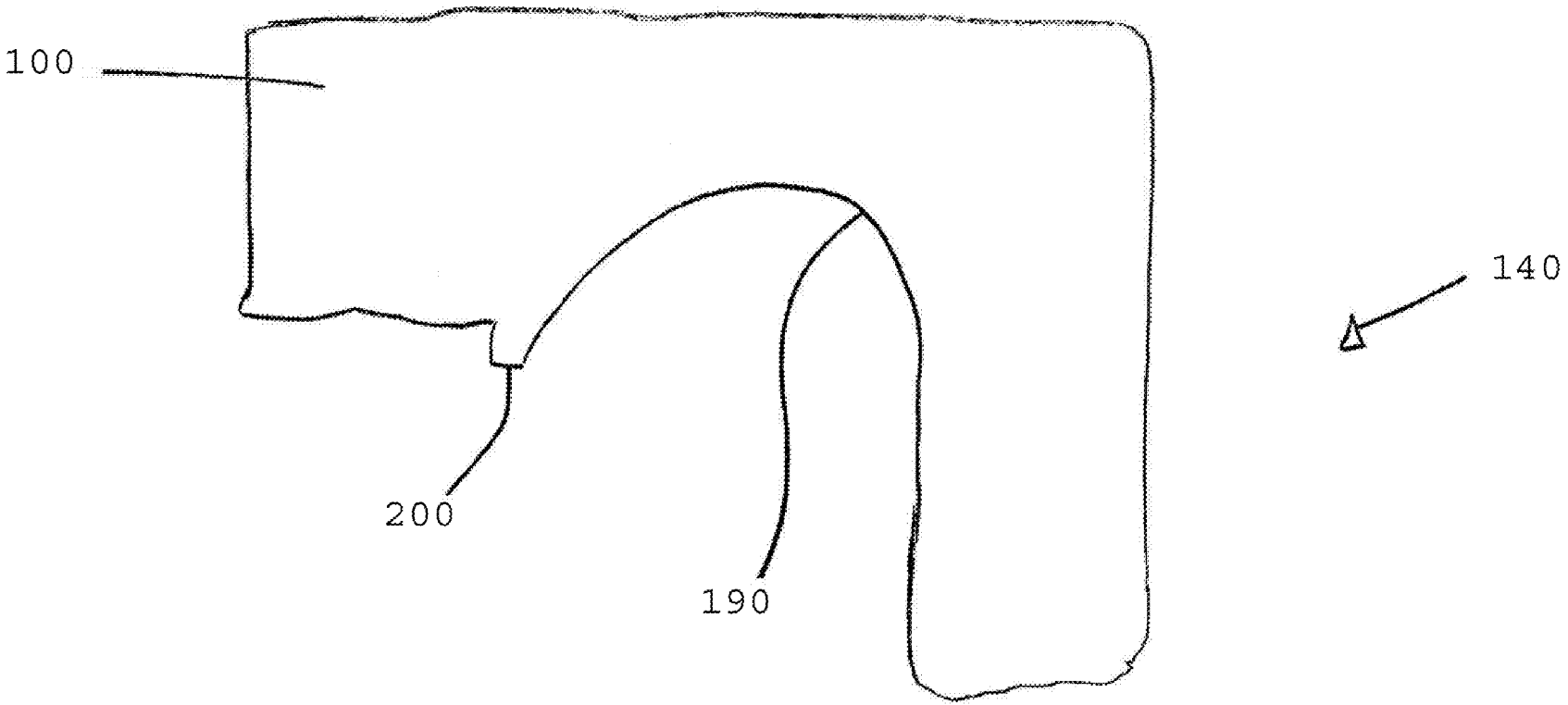
FIG. 7A is an enlarged side view of the carrier body embodying the principles of the present invention.

As shown in FIGS. 7 and 7A, the bottom edge 190 of carrier body 140 is shaped to operate as a cam follower. The apex 200 of the cam follower is disposed beneath the counter balance receiver 100 in the preferred embodiment, but it will be appreciated by those skilled in the art that apex 200 could be located virtually anywhere along bottom edge 190.

Figure 8:
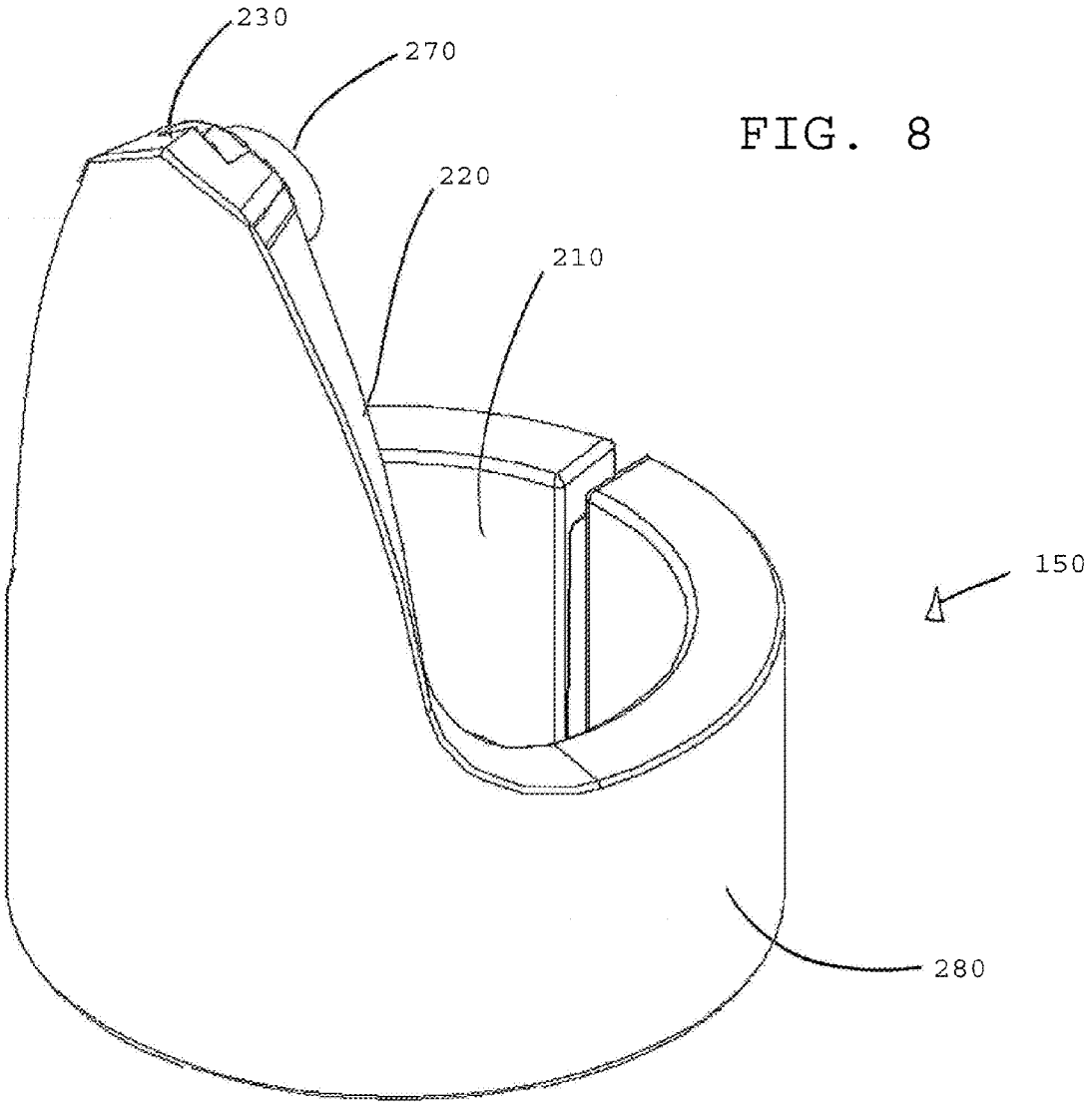
FIG. 8 is an enlarged perspective view of the carrier support member embodying the principles of the present invention.

Bottom edge 190 of carrier body 140 is formed as a cam follower configured to engage the upper surface 220 (as shown in FIG. 8) of a carrier support member 150 that is fixedly fastened to support rod 120 and that acts as a cam in relation to bottom edge 190 of carrier body 140.

As noted above, carrier support member 150 preferably is fixedly fastened onto the support rod 120 such that support rod 120 passes through central opening 210 formed in carrier support member 150. A male pin 270 protrudes inwardly, towards support rod 120, and snaps into a mating hole (not shown) in support rod 120 to help fix carrier support member 150 to support rod 120 and to prevent rotation of carrier support member 150 about support rod 120.

Preferably, carrier support member 150 is configured with an area 280 for accepting a hose clamp 90 (as shown in FIG. 4, for example) to clamp carrier support member 150 on to support rod 120 for additional support.

As shown in FIG. 8, in the preferred embodiment of the present invention, the top portion of the cam (upper surface 220 of carrier support member 150) is not as steep as the sides, and the cam top 230 is formed as a sharp point so the cam follower (bottom edge 190 of carrier body 140) cannot come to rest at the top of the cam but must fall down one side or the other of the cam (upper surface 220 of carrier support member 150). In this manner, paddle 10 will always "self-reset," as the cam follower (bottom edge 190 of carrier body 140) falls to one side of the cam (upper surface 220 of carrier support member 150) or the other.

Moreover, the transition of the slope of the cam (upper surface 220 of carrier support member 150), from steep at the bottom to less steep towards cam top 230, is designed to reduce wear of the cam (upper surface 220 of carrier support member 150). That is, when paddle target 10 is struck hard, carrier body 140 is forced around the cam (upper surface 220 of carrier support member 150) of carrier support member 150 with so much speed that apex 200 of carrier body 140 "jumps over" (and disengages from) cam top 230 of carrier support member 150, thus advantageously reducing wear.

Carrier support member 150 also serves an additional function by serving as a limiter—it limits the vertical travel of the carrier body 140 disposed beneath it along support rod 120. Moreover, by adding a rubber o-ring, or other force-absorbing device, at the base of carrier support member 150, some cushioning and breaking effect is created when the carrier body 140 disposed beneath carrier support member 150 engages the underside of the carrier support member 150 above it.

In this manner, the impact of particularly high-speed projectiles can be advantageously dampened. The same effect can be achieved for the upper-most paddle 10 disposed along support rod 120 by adding a rubber o-ring, or other force-absorbing device, on to the support rod 120 just above the upper-most paddle 10 and beneath the cap member 50.

As shown in FIGS. 1, 3 and 5, protective apron 45 is disposed on the front of target 1 and protects target 1 and it mechanics from potential damage caused by stray projectiles. Besides serving as a protective cover for the mechanics of target 1, apron 45 also has another critical function—it dampens paddles 10 as paddles 10 swing from one side of target 1 to the other side of target 1 after being impacted by a projectile.

That is, if paddle 10 is struck with a significant force it is most efficient and effective if the kinetic energy of the projectile is absorbed not by a hard, dead stop but by something which provides a long drawn out slowing of paddle 10.

The weight and flexibility of apron 45 provide this function, and apron 45 may be formed of various materials to accomplish this goal. For example, apron 45 preferably is made from a soft plastic extrusion but could be made of a metal chain mesh, etc. Apron 45 also could be cut horizontally a few inches in from its vertical edge. Such cuts would be spaced to allow the curtain to independently react to each paddle 10 when paddle 10 engages apron 45.

It also should be noted that the flexibility of paddles 10 affects the absorption effect of apron 45 such that stiffer, more rigid paddles transfer more kinetic energy to apron 45, resulting in less bounce-back of paddles 10.

In the preferred embodiment of target 1, apron 45 is mounted to target 1 through base member 40 and cap member 50. As discussed above, the forward surfaces of base member 40 and cap member 50 include a plurality of male protrusions 240 configured to matingly engage holes 290 formed in apron 45, shown in FIGS. 5 and 10.

In the preferred embodiment, apron 45 is secured to base member 40 and cap member 50 using apron clips 20 and 30 engaged with cap member 50 and base member 40, respectively. In this manner apron 45 will not slip off of male protrusions 240 when target 1 is in use.

Figure 12:
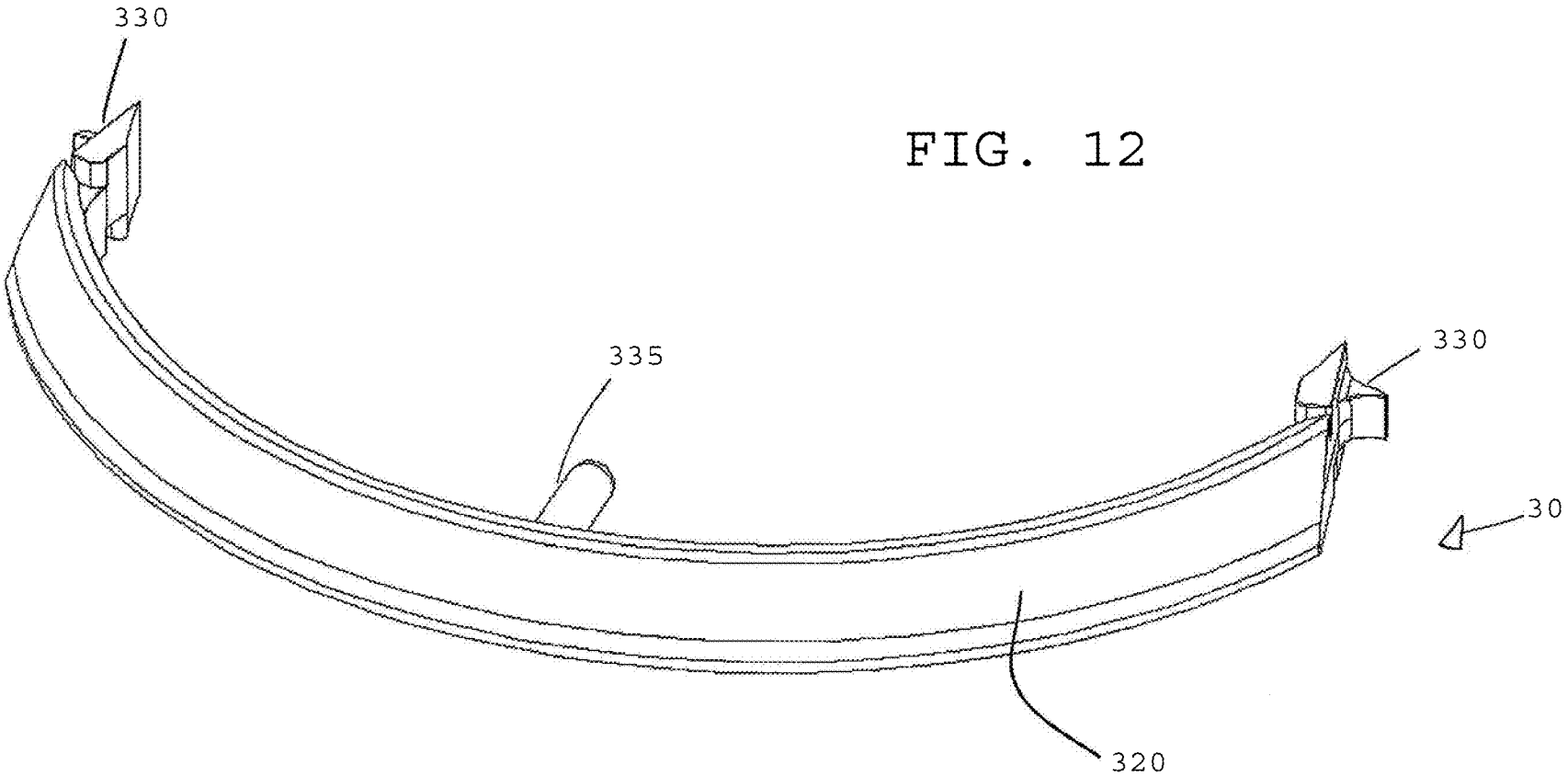
FIG. 12 is an enlarged perspective view of the lower apron clip of the self-resetting paddle target embodying the principles of the present invention.
Figure 13:
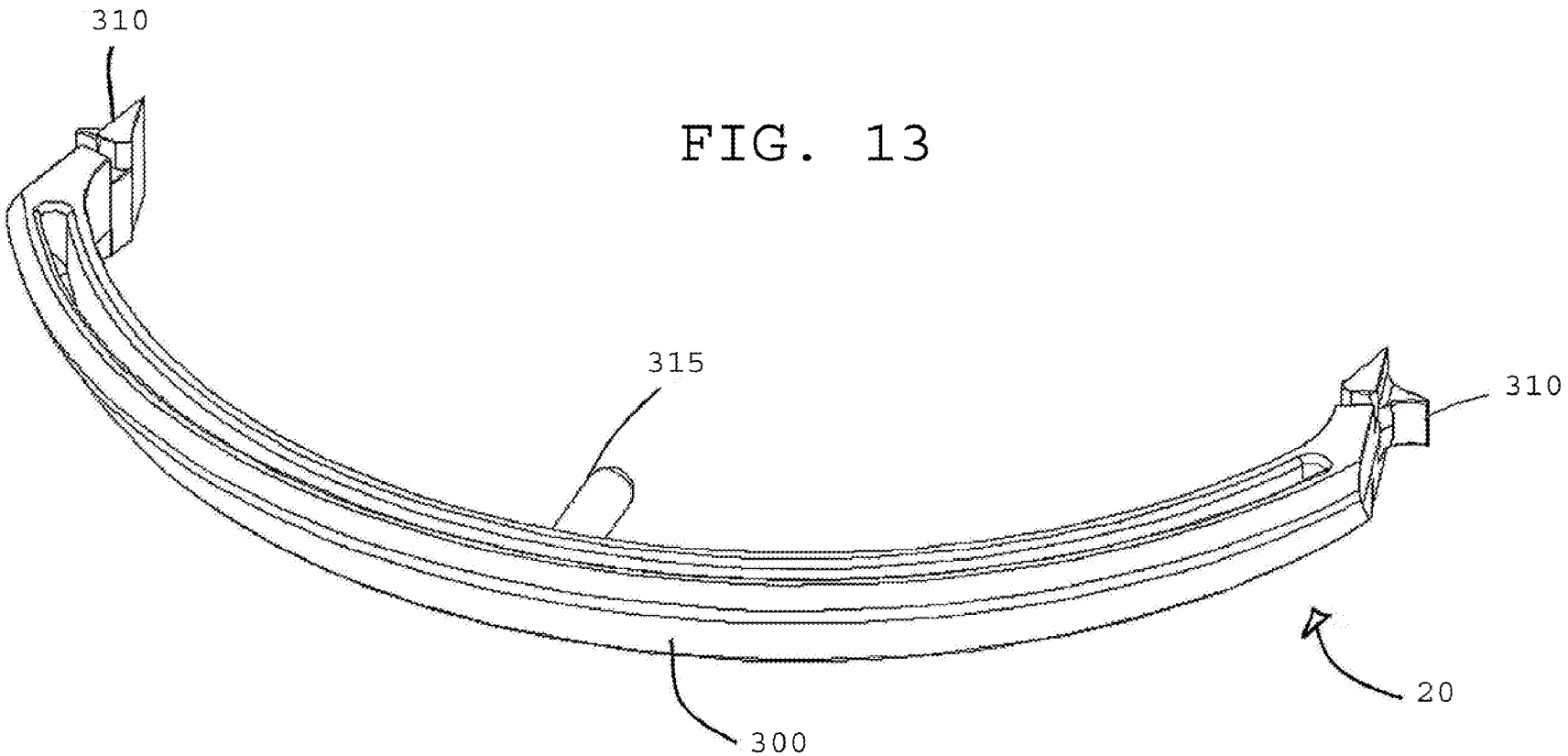
FIG. 13 is an enlarged perspective view of the upper apron clip of the self-resetting paddle target embodying the principles of the present invention; and, FIG. 14 is a fragmentary perspective view of the self-resetting paddle target embodying the principles of the present invention being struck by a projectile, namely an arrow.

As shown in FIGS. 12-13, each apron clip 20, 30 has a male protrusion 335 formed in the center of the apron clip, and extending rearwardly therefrom, and a snap tooth 330 at each end configured to matingly engage base member 40 and cap member 50 to hold apron clips 20, 30 in place.

The forward surfaces of apron clips 20, 30 preferably are configured in a wedge-like geometry to deflect projectiles inward towards apron 45, and not away from the target 1, to help catch and deaden errant projectiles. Preferably, apron clips 20, 30 are made of an impact resistant material to preserve their useful life.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention.

It is to be understood that no limitation with respect to the specific embodiments illustrated is intended or should be inferred. The disclosure is intended to cover by the appended claims all such modifications as fall within the scope of the claims.

What is claimed is:

1. A self-resetting paddle target comprising:

a frame, the frame having a tubular support rod;

at least one paddle;

at least one carrier body, the at least one carrier body rotatably mounted to the tubular support rod; and, at least one a carrier support member, the at least one carrier support member non-rotatably mounted to the tubular support rod;

wherein the at least one paddle is mounted to the at least one carrier body;

wherein the at least one carrier body and the at least one carrier support member are engaged in a cam and cam follower configuration; and, wherein the at least one carrier support member with which the at least one carrier body is engaged in the cam and cam follower configuration prevents the at least one carrier body from traveling vertically along the tubular support rod past the at least one carrier support member with which the at least one carrier body is engaged in the cam and cam follower configuration when the carrier body rotates about the tubular support rod.

2. The self-resetting paddle target of claim 1 wherein the at least one carrier body is configured as a cam follower and the at least one carrier support member is configured as a cam in the cam and cam follower configuration.

3. The self-resetting paddle target of claim 1 wherein the frame further comprises a base member and a cap member, the tubular support rod extending between the base member and the cap member.

4. The self-resetting paddle target of claim 3 further comprising a least one frame rod configured to engage the base member and the cap member and to support the frame.

5. The self-resetting paddle target of claim 1 wherein the cam and cam follower configuration of the at least one carrier body and the at least one carrier support member is configured to control a rotation of the carrier body about the tubular support rod.

6. The self-resetting paddle target of claim 1 wherein the cam and cam follower configuration is biased to force the cam follower to a side of the cam.

7. The self-resetting paddle target of claim 2 wherein the cam and cam follower configuration is biased to force the at least one carrier body to a side of the target.

8. The self-resetting paddle target of claim 1 wherein the cam and cam follower configuration is configured to force the at least one paddle to reset itself after being impacted by a projectile.

9. The self-resetting paddle target of claim 1 wherein the at least one paddle is flexible.

10. The self-resetting paddle target of claim 1 wherein the at least one paddle is rigid.

11. The self-resetting paddle target of claim 3 further comprising an apron, the apron extending between the base member and the cap member, wherein the apron is configured to slow a movement of the at least one paddle.

12. The self-resetting paddle target of claim 1 wherein the at least one paddle is removably mounted to the at least one carrier body.

13. The self-resetting paddle target of claim 1 wherein the at least one carrier body is configured to accept at least one counterweight for balancing the at least one paddle.

14. The self-resetting paddle target of claim 1 wherein the at least one paddle comprises a plurality of paddles, and wherein the at least one carrier body comprises a plurality of carrier bodies, and wherein the at least one carrier support member comprises a plurality of carrier support members.

15. The self-resetting paddle target of claim 14 wherein the plurality of paddles comprises at least one rigid paddle and at least one flexible paddle.

* * * * *

UNITED STATES PATENT AND TRADEMARK OFFICE

CERTIFICATE OF CORRECTION

PATENT NO. : 7,690,656 B2
APPLICATION NO. : 12/350954
DATED : April 6, 2010
INVENTOR(S) : Charles A. Saunders It is certified that error appears in the above-identified patent and that said Letters Patent is hereby corrected as shown below:

Column 4, lines 21-23: The word "know" should appear in the sentence so that it reads as follows: "However, those skilled in the art know that other suitable materials can be used."

Column 5, line 10: The word "the" should be replaced with the word "to" so that the line reads as follows: "...be used to change the game or adapt..."

Signed and Sealed this

Eighth Day of June, 2010

David J. Kappos

David J. Kappos
*Director of the United States Patent and Trademark Office*